US006916205B1

(12) United States Patent
Kaneko

(10) Patent No.: US 6,916,205 B1
(45) Date of Patent: Jul. 12, 2005

(54) SHIELD ELECTRIC CABLE CONNECTOR

(75) Inventor: Shuhei Kaneko, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 10/666,349

(22) Filed: Sep. 19, 2003

Related U.S. Application Data

(63) Continuation of application No. PCT/JP03/01336, filed on Feb. 7, 2003.

(30) Foreign Application Priority Data

Feb. 8, 2002 (JP) ..... 2002-031797

(51) Int. Cl.[7] ..... H01R 9/03
(52) U.S. Cl. ..... 439/610; 439/98
(58) Field of Search ..... 439/610, 98, 585; 174/65 R

(56) References Cited

U.S. PATENT DOCUMENTS 5,691,506 A * 11/1997 Miyazaki et al. ..... 174/65 R
5,895,291 A * 4/1999 Furio et al. ..... 439/610
5,938,475 A * 8/1999 Penner et al. ..... 439/610

FOREIGN PATENT DOCUMENTS

| | | |
|---|---|---|
| JP | 2-44262 | 3/1990 |
| JP | 3772322 | 4/1998 |
| JP | 10-144405 | 5/1998 |
| JP | 3211587 | 7/2001 |
| JP | 3260322 | 12/2001 |
| JP | 2002-280131 | 9/2002 |

* cited by examiner

*Primary Examiner*—Michael C. Zarroli
(74) *Attorney, Agent, or Firm*—Cohen, Pontani, Lieberman & Pavane

(57) ABSTRACT

A shield electric cable connector for electrically connecting a shield electric cable to a mate member, wherein the shield electric cable includes one terminal portion that is peeled for connecting said connector and the mate member. The terminal portion has a conductive shield layer exposed from a sheath of the shield electric cable. The connector includes a conductive shield pipe surrounding the terminal portion of the shield electric cable and a conductive shield-connecting member surrounding the shield layer between the exposed shield layer and the shield pipe, the shield-connecting member electrically connecting the exposed shield layer to the shield pipe. The shield-connecting member has a pair of halves for sandwiching the exposed shield layer from both sides in a radial direction of the exposed shield layer.

9 Claims, 5 Drawing Sheets

SHIELD ELECTRIC CABLE CONNECTOR

RELATED APPLICATIONS

This application is a U.S. Continuation Application under 35 USC 111(a) of International Application PCT/JP03/01336, filed on 7 Feb. 2003.

TECHNICAL FIELD

The present invention relates to a shield electric cable connector for connecting a shield electric cable to a mate member.

BACKGROUND ART

A shield electric cable has a core wire for transmitting electric power and signals, that is covered with a shield layer with an insulating layer therebetween, thereby preventing the core wire from being a noise source at the electric power transmission or preventing an external noise from being superimposed on the core wire of the shield electric cable. In other words, the shield electric cable is secured of electromagnetic shield characteristics by the shield layer.

In case that such a shield electric cable is connected to a mate member, such as another shield electric cable and a device, a shield electric cable connector is fixed to the peeled terminal portion of the shield electric cable to retain the shield characteristics. This type of shield electric cable connector is disclosed, for example, in Japanese Patent Laid-Open Publication No. 6-260246. The disclosed shield electric cable connector has a shield pipe covering the peeled terminal portion of a shield electric cable and having a tip end that is electrically connected to the shield of a mate member. The shield electric cable connector further has a sleeve into which the shield layer exposed at the terminal portion of the shield electric cable is inserted, thereby electrically connecting the exposed shield layer and the base end of the shield pipe. More specifically, the sleeve is formed to have steps and has a large diameter portion contactable with the shield pipe, a small diameter portion fastened upon the exposed shield layer by caulking, and a middle diameter portion fastened upon a sheath by caulking between the large and small diameter portions.

When the shield electric cable connector disclosed in the publication is attached to a shield electric cable, however, an operator is required to do vexatious and complicated work of inserting the terminal portion of the shield electric cable into the sleeve and then caulking the sleeve. Moreover, such work is unsuitable for automation utilizing machine, or mass production.

As for the shield electric cable connector described in the publication, there is a wide variation in the contact state between the exposed shield layer and the small diameter portion of the sleeve with respect to each connector depending on the accuracy of the caulking work itself. Thus, there is fear that there occurs a variation in shield characteristics. If the sheath is deteriorated to shrink under the influence of heat, and the contact state between the sheath and the middle diameter portion of the sleeve becomes unstable, the sleeve cannot be firmly attached to the shield electric cable, resulting in a potential decline in the shield characteristics.

DISCLOSURE OF THE INVENTION

An object of the present invention is to provide a shield electric cable connector that can be easily and automatically fixed to a shield electric cable by using machine and has excellent shield characteristics.

To achieve the above object, the present invention provides a shield electric cable connector for electrically connecting a shield electric cable to a mate member, the shield electric cable including one terminal portion peeled for connecting said connector and the mate member, the terminal portion having a conductive shield layer exposed from a sheath of the shield electric cable, the connector comprising a conductive shield pipe surrounding the terminal portion of the shield electric cable and a conductive shield-connecting member surrounding the shield layer between the exposed shield layer and the shield pipe and electrically connecting the exposed shield layer to the shield pipe, wherein the shield-connecting member has a pair of halves for sandwiching the exposed shield layer from both sides in a diametral direction of the exposed shield layer.

BEST MODE OF CARRYING OUT THE INVENTION

Figure 1:
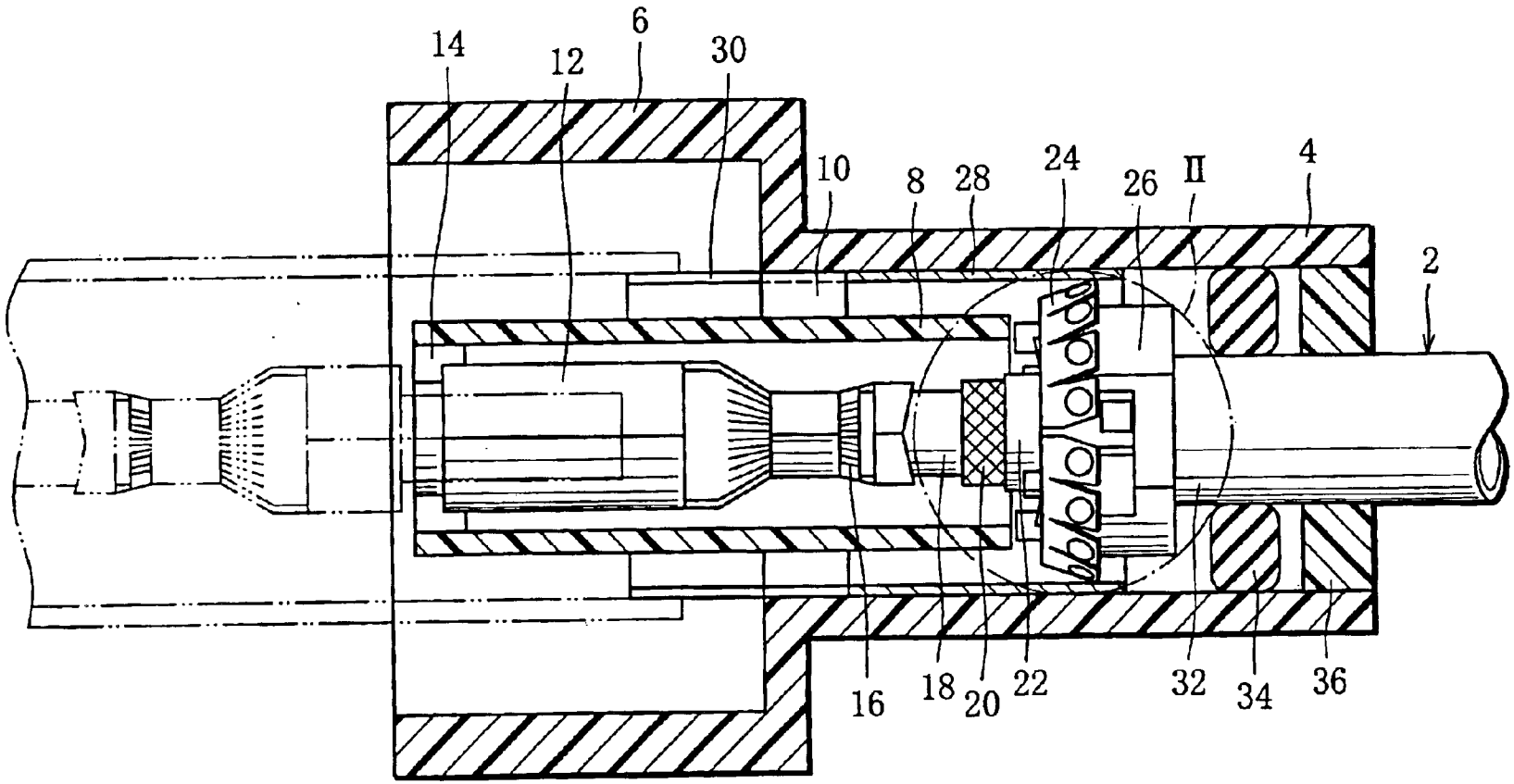
FIG. 1 is a partial sectional view showing a shield electric cable connector of an embodiment.

FIG. 1 illustrates a shield electric cable connector of an embodiment. The connector is fixed to a peeled terminal portion of a shield electric cable 2 and utilized for connecting the shield electric cable 2 to a mate member, such as another shield electric cable and a device.

The connector includes a cylindrical connector housing 4 having a tip end portion 6 with a large diameter. The tip end portion 6 is interfittable with a housing, not shown, of a connector that is attached to a shield electric cable of the mate member. Moreover, the housing 4 has a support portion 8 that is integrally formed in the inside on the tip end portion side. The support portion 8 is formed into a cylinder whose outer circumference is attached to the housing 4 through an arm 10.

Disposed in the support portion 8 is a female terminal (hereinafter referred to as metal fitting with reference number 12) having a tip end portion interfittable with a male terminal of the mate member. The metal fitting 12 is controlled in movement along the axial direction and radial direction of the support portion 8 by a stepped portion 14 formed in the support portion 8 and a hook, not shown.

A core wire 16 and an insulating layer 18 of the shield electric cable 2, that have been peeled and exposed, are fixed to a base end side of the metal fitting 12 by caulking. In the terminal portion of the electric cable 2, a shield layer 20 is exposed at a position adjacent to the exposed insulating layer 18. The shield layer 20 comprises metal wires braided into a mesh and surrounds the core wire 16 and the insulating layer 18 in a circumferential direction. Moreover, a metal tape 22 made of copper is wound around the exposed shield layer 20 in the circumferential direction thereof.

The metal tape 22 is surrounded by a metal shield-connecting member 24 and a resinous carrier member 26 holding the shield-connecting member 24 mentioned below. The shield-connecting member 24 has an outer circumference in contact with the inside of a metal shield pipe 28.

The shield pipe 28 is situated cocentrically within the housing 4 and surrounds the peeled terminal portion of the electric cable 2 in the axial direction of the electric cable 2. An end portion of the shield pipe 28, that is opposite to the shield-connecting member 24, is interfittable with a shield pipe of the mate member. In the end portion of the shield pipe 28 on the mate member side, there are formed slits 30 and a projection, not shown. The slits 30 elongates in the axial direction of the shield pipe 28, whereas the projection protrudes from the outer circumferential surface of the shield pipe 28 toward the housing 4. Arms 10 are pinched by the slits 30, and the projection is engaged with a recessed portion, not shown, that is formed in the housing 4, thereby controlling the movement of the shield pipe 28 in the circumferential and axial directions of the housing 4.

The carrier member 26 extends in the axial direction of the electric cable 2 and also surrounds a sheath 32 of the electric cable 2 in abutment with the exposed shield layer 20. The sheath 32 extending from an end face of the carrier member 26 located on the opposite side of the metal fitting 12 is interfitted with a waterproof ring 34 made of rubber and a resinous cap member 36.

Figure 2:
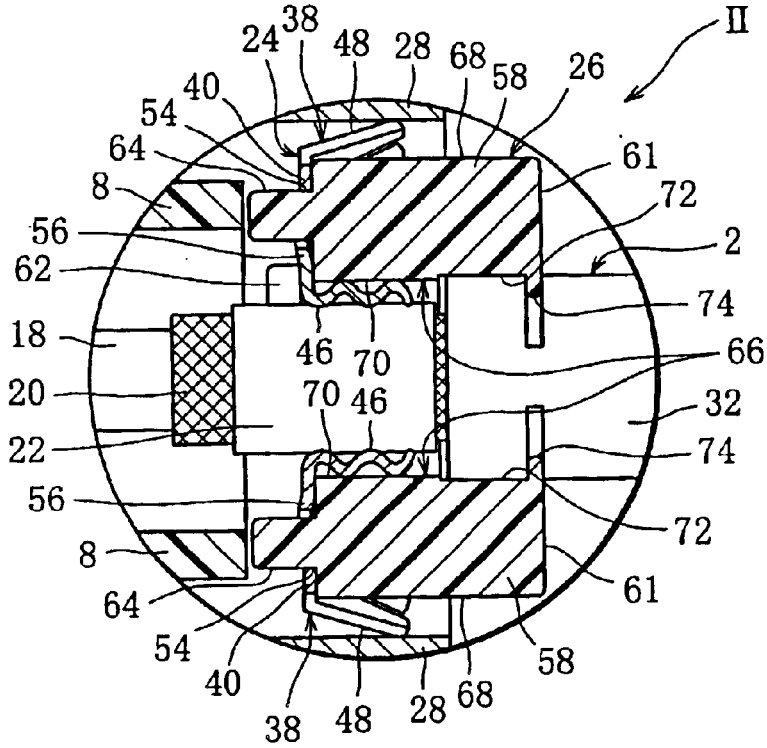
FIG. 2 is an enlarged sectional view of the region II in FIG. 1.
Figure 3:
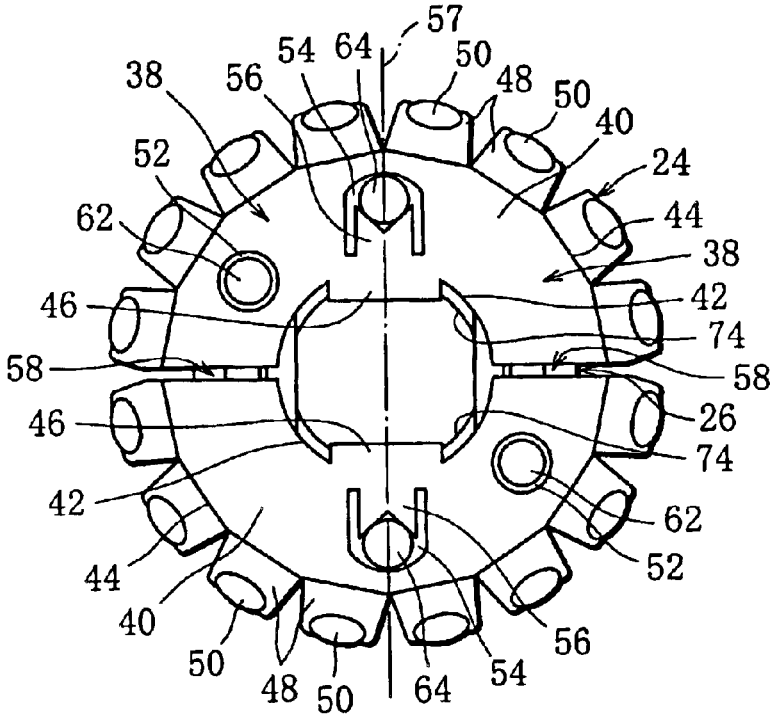
FIG. 3 is an elevation view of a shield-connecting member that is utilized for the connector shown in FIG. 1 and fixed to a carrier member.

FIG. 2 is an enlarged partial sectional view showing an area II of FIG. 1 and illustrates a cross-section of the shield-connecting member 24 and the carrier member 26 that holds the shield-connecting member 24. FIG. 3 is an elevation view of the shield-connecting member 24 held by the carrier member 26.

The shield-connecting member 24 includes a pair of half bodies 38, 38 that is situated to possess two-fold rotation symmetry with respect to an axis of the shield-connecting member 24. Each half body 38 has a shield wall portion 40 formed in a substantially semi-circular shape. The shield wall portion 40 is included on a plain surface orthogonal to the axis of the electric cable 2. When the half bodies 38, 38 are supported by the carrier member 26, a pair of shield wall portions 40, 40 forms a substantially circular shape as a whole with a small gap therebetween.

Each shield wall portion 40 has an inner circumference 42 and an outer circumference 44 in the shape of a substantially circular arc, and the inner circumference 42 surrounds the metal tape 22. A plate-like corrugated connecting portion 46 Is integrally formed on the inner circumference 42. The corrugated connecting portion 46 extends in an axial direction of the metal tape 22 to stick fast to the metal tape 22.

The outer circumference 44 of each shield wall portion 40 elongates in a circumferential direction of the shield pipe 28 and is located slightly away from an inner circumferential surface of the shield pipe 28. A plurality of substantially trapezoidal connecting portions 48 are integrally formed on the outer circumference 44. The trapezoidal connecting portions 48 are aligned along the outer circumference 44 and each obliquely extend toward the shield pipe 28 on the carrier member 26 side. On an outside facing surface of the trapezoidal connecting portion 48, there is formed a circular bulge portion 50 projecting to the shield pipe 28 side. The bulge portion 50 is in contact with an inner circumference of the shield pipe 28. More specifically, the diameter of the trapezoidal connecting portion 48 is reduced by the shield pipe 28 through the bulge portion 50, and the bulge portion 50 is in tight contact with the shield pipe 28 due to resilient repulsive force of the trapezoidal connecting portion 48.

There are formed two through-holes 52, 54 in each shield wall portion 40. The through-hole 52 has a circular opening, whereas the through-hole 54 has an opening with four sides including one arcuate side and three straight sides. Formed integrally on the straight side opposite to the arcuate side is a claw 56 elongating toward the arcuate side while slanting toward the metal fitting 12 side. The claw has a tip end 56 that is cut in a V shape.

In the shield-connecting member 24, the above-mentioned corrugated connecting portions 46, 46 and through-holes 54, 54 are situated on a straight line 57 that stretches in the radial direction passing the axis of the shield-connecting member 24. The half bodies 38, 38 are located away from each other in the direction along the straight line 57.

Figure 4:
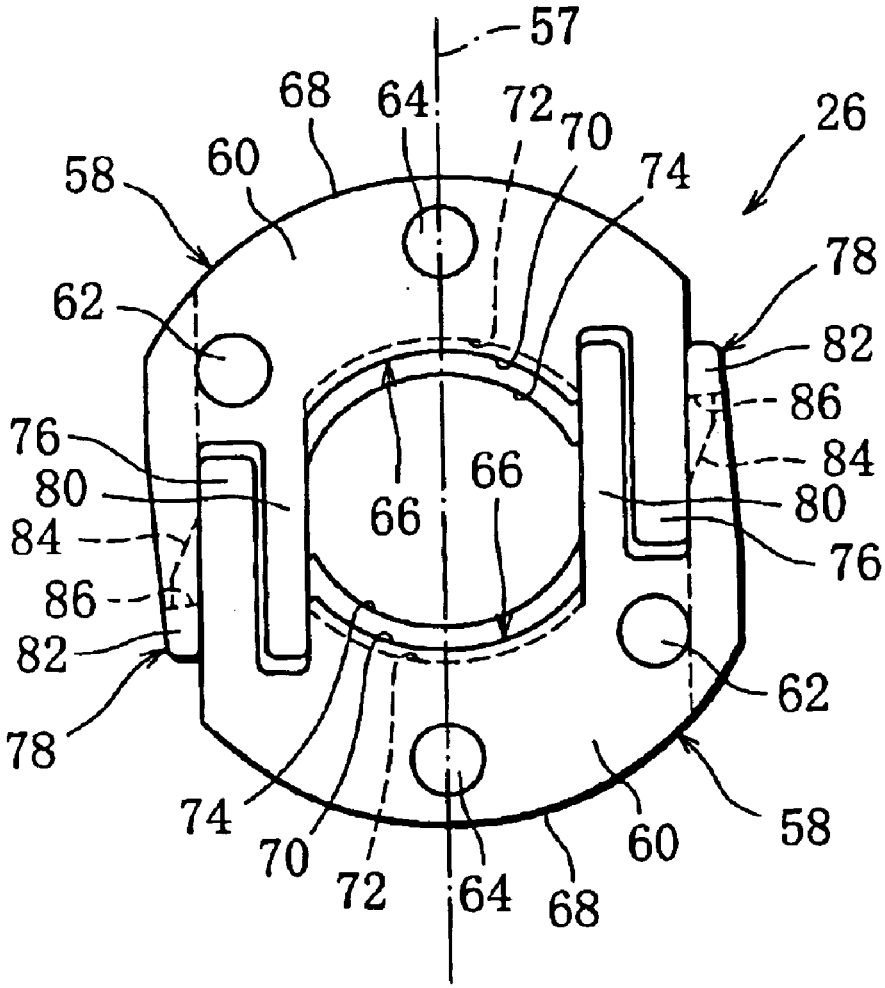
FIG. 4 is an elevation view of the carrier member to which the shield-connecting member shown in FIG. 3 is fixed.
Figure 5:
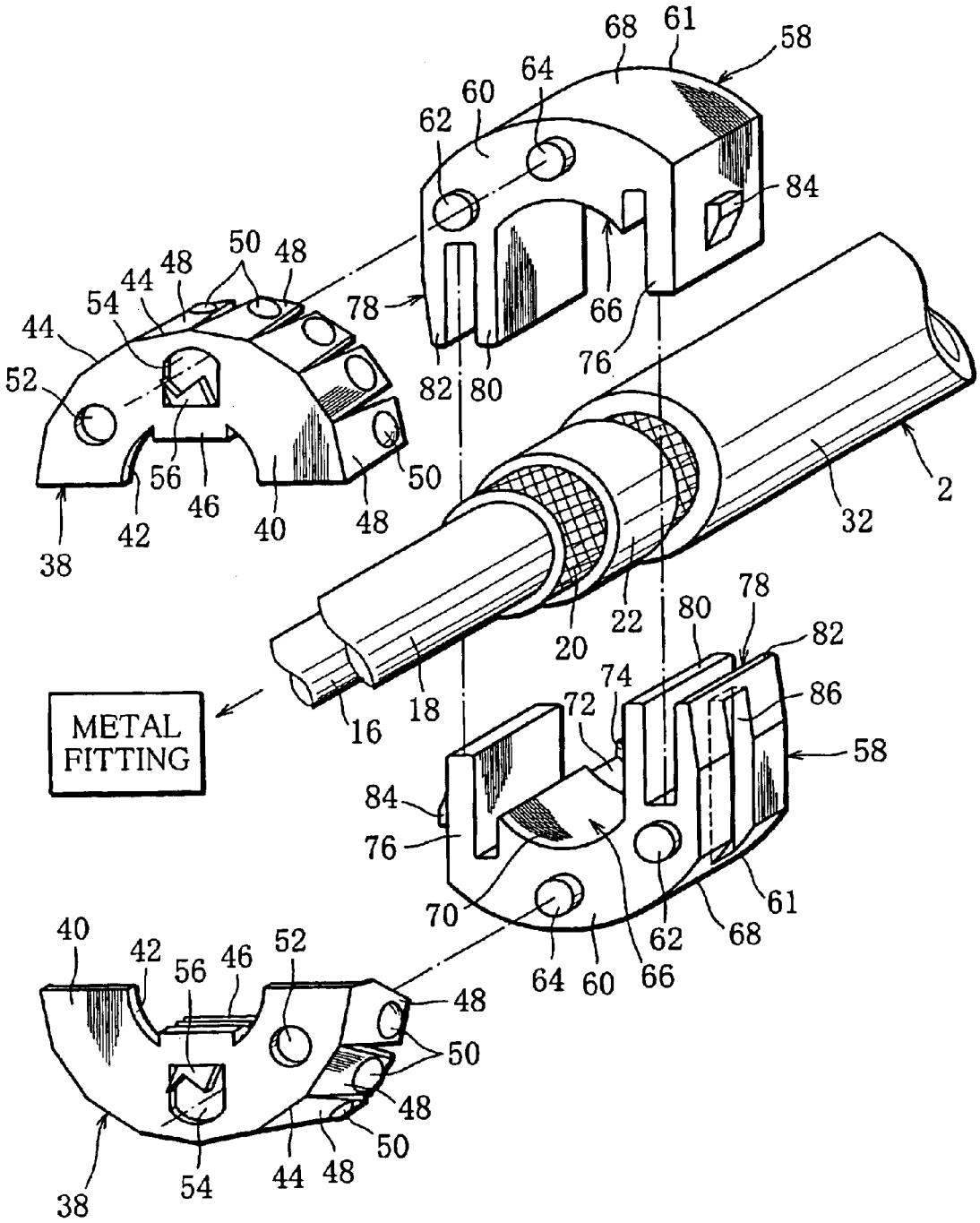
FIG. 5 is an exploded view showing the shield-connecting member and the carrier member that are utilized for the connector shown in FIG. 1.

FIG. 4 illustrates the carrier member 26 formed into a cylinder elongating in the axial direction of the electric cable 2. The carrier member 26 includes a pair of resinous bodies 58, 58 coupled with each other. The resinous bodies 58, 58 are coupled with each other so as to possess two-fold rotation symmetry with respect to the axis of the carrier member 26.

Referring again to FIGS. 2 and 3, each resinous body 58 has a pair of end faces 60, 61, and two cylindrical projections 62, 64 protrude from the end face 60, that is in contact with the shield wall portion 40, along the axial direction of the carrier member 26. The projections 62, 64 are so formed as to fit into the through-holes 52, 54 of the half body 38, respectively. The projections 62, 64 of the resinous body 58 are inserted into the through-holes 52, 54 of the half body 38, respectively. Accordingly, the half body 38 is accurately positioned on the end face 60 of the resinous body 58 by the projections 62, 64 and the through-holes 52, 54. The V-shaped tip end of the claw 56 is engaged with an outer circumference of the projection 64 inserted into the through-hole 54, which prevents the projection 64 from escaping. The half body 38 and the resinous body 58 are thus fixed to each other.

Each resinous body 58 has an arcuate inner circumferential wall 66 and an arcuate outer circumferential wall 68, that extend between the end face 60 and the other end face 61. The inner and outer circumferential walls 66 and 68 are formed concentrically with each other. The inner circumferential wall 66 is formed to have a step, and includes a small arcuate portion 70 on the end face 60 side and a large arcuate portion 72 on the other end face 61 side. The small arcuate portion 70 surrounds the exposed shield layer 20 and the metal tape 22 wound therearound, and pushes the corrugated connecting portion 46 against the metal tape 22 to tighten the contact between the corrugated connecting portion 46 and the metal tape 22.

The large arcuate portion 72 surrounds the sheath 32 in abutment with the exposed shield layer 20. A ridge portion 74 extending along an inner circumference of the large arcuate portion 72 is integrally formed on the other end face 61 side of the end edge of the large arcuate portion 72. The ridge portion 74 protrudes toward the inside along the radial direction of the carrier member 26, that is, the sheath 32 side. Therefore, the ridge portion 74 bites into the outer circumference of the sheath 32 and controls the movement of the carrier member 26 along the axial direction of the electric cable 2. Moreover, the ridge portion 74 credibly controls the movement of the carrier member 26 even if the sheath 32 is deteriorated to shrink.

Referring again to FIG. 4, a plate-like male engagement portion 76 is integrally formed in one side portion of the outer circumferential wall 68. The male engagement portion 76 elongates in parallel with the straight line 57 on which the corrugated connecting portions 46, 46 and the through-holes 54, 54 are situated. Furthermore, a female engagement portion 78 is integrally formed in the other side portion of the outer circumferential wall 68, and the male engagement portion 76 of the companion resinous body 58 can be inserted into the female engagement portion 78. More specifically, the female engagement portion 78 includes a pair of parallel walls 80, 82. The parallel walls 80, 82 are located away from each other with a groove, in which the male engagement portion 76 is fitted, therebetween. The groove also stretches along the straight line 57.

There is formed a projection 84 on a side face of the male engagement portion 76, and a hole 86 corresponding to the projection 84 is arranged on a side face of the parallel wall 82 of the female engagement portion 78. Therefore, when the projection 84 is engaged with the hole 86 of the parallel wall 82, the resinous members 58, 58 are fixed to each other.

Since the male engagement portion 76 is inserted into the female engagement portion 78 along the straight line 57, the small arcuate portion 70 of the inner circumferential wall 66 effectively pushes the corrugated connecting portion 46 against the metal tape 22, while the ridge portion 74 of the large arcuate portion 72 efficiently bites into the sheath 32.

The shield electric cable connector of the above-described embodiment can be manufactured and assembled by the following method.

Figure 6:
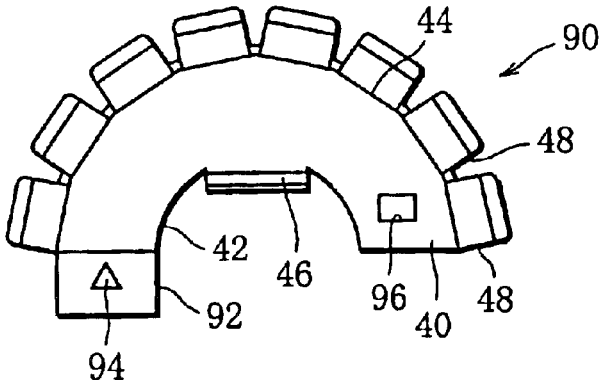
FIG. 6 is an elevation view of a half body included in another shield-connecting member that is utilized for the connector shown in FIG. 1.

First, a metal plate is molded by press working. Then, the corrugated connecting portions 46 and the trapezoidal connecting portions 48 are bent to produce half bodies 38, 38. Meanwhile, resin is molded into resinous bodies 58, 58. Next, the prepared electric cable 2 is peeled at the terminal portion thereof, and the cap member 36 and the waterproof ring 34 are fixed at the respective prescribed positions of the electric cable 2, that is located away from the peeled terminal portion. Thereafter, the metal tape 22 is wound around the exposed shield layer 20, and the exposed core wire 16 and the insulating layer 18 are fixed to the base end portion of the metal fitting 12 by caulking. As shown in FIG. 6, after the half bodies 38, 38 are fixed to the respective resinous bodies 58, 58, the corrugated connecting portions 46, 46 are pushed against the metal tape 22, and the two resinous bodies 58, 58 are coupled with each other so that the ridge portions 74, 74 bite into the sheath 32. Then, the electric cable 2, to which the shield-connecting member 24 and the like are fixed, is introduced into the housing 4 into which the shield pipe 28 is inserted, thus assembling the shield electric cable connector. At the time of the introduction of the electric cable 2, the diameter of the trapezoidal connecting portion 48 of the shield-connecting member 24 is reduced by the shield pipe 28, and the shield pipe 28 and the bulge portion 50 of the trapezoidal connecting portion 48 are brought into tight contact with each other.

According to the shield electric cable connector of the above-described embodiment, the metal tape 22 is sandwiched between the half bodies 38, 38 from both sides in the radial direction thereof. Therefore, it is not required to perform caulking work when the shield-connecting member 24 is fixed to the electric cable 2. Consequently, the shield-connecting member 24 can be promptly and easily attached to the electric cable 2, and in addition it is possible to automate the attaching work by using machine.

Although the shield electric cable connector of the above-mentioned embodiment has the shield pipe 28 and the exposed shield layer 20 that are electrically connected to each other by the half bodies 38, 38, the shield electric cable connector has shield characteristics substantially equivalent to those of a conventional shield electric cable connector. This is considered to happen for the following reasons.

According to the shield electric cable connector of the embodiment, the shield-connecting member 24 electromagnetically shields between the inner circumference of the shield pipe 28 and the exposed shield layer 20. The shield-connecting member 24 has the gap between the half bodies 38, 38 and gaps among the trapezoidal connecting portions 48, and also includes the through-holes 52, 54. The through-holes 52, 54, however, are adequately small, and moreover a gap that extends in the radial direction of the shield electric cable 2 like the above-mentioned gaps has still smaller harmful effects on the shield characteristics than a gap that extends in the circumferential direction of the electric cable 2. Therefore, in spite of having the gaps and the through-holes, the shield-connecting member of the embodiment has the shield characteristics substantially equivalent to those of a conventional shield electric cable connector.

The present invention is not limited to the aforementioned embodiment and may be practiced in a variety of alternate embodiments. For example, the metal fitting 12 may be a male terminal instead of a female terminal.

A shield-connecting member 90 as shown in FIG. 6 may be utilized In the above embodiment in replacement of the shield-connecting member 24. The shield-connecting member 90 has a pair of half bodies 38, 38. Each half body 38 has a superposed portion 92 in replacement of the through-holes 52, 54, the superposed portion 92 extending toward the companion half body 38. The superposed portion 92 is provided with a V-shaped cut that marks off a triangular projection 94, and the triangular projection 94 protrudes from the superposed portion 92. There is formed a hole 96 in a shield wall portion 40 at a position corresponding to the projection 94. The projection 94 is fitted in the hole 96, and thus the half bodies 38, 38 are coupled with each other. Accordingly, with the shield-connecting member 90, the carrier member 26 is unnecessary.

Figure 7:
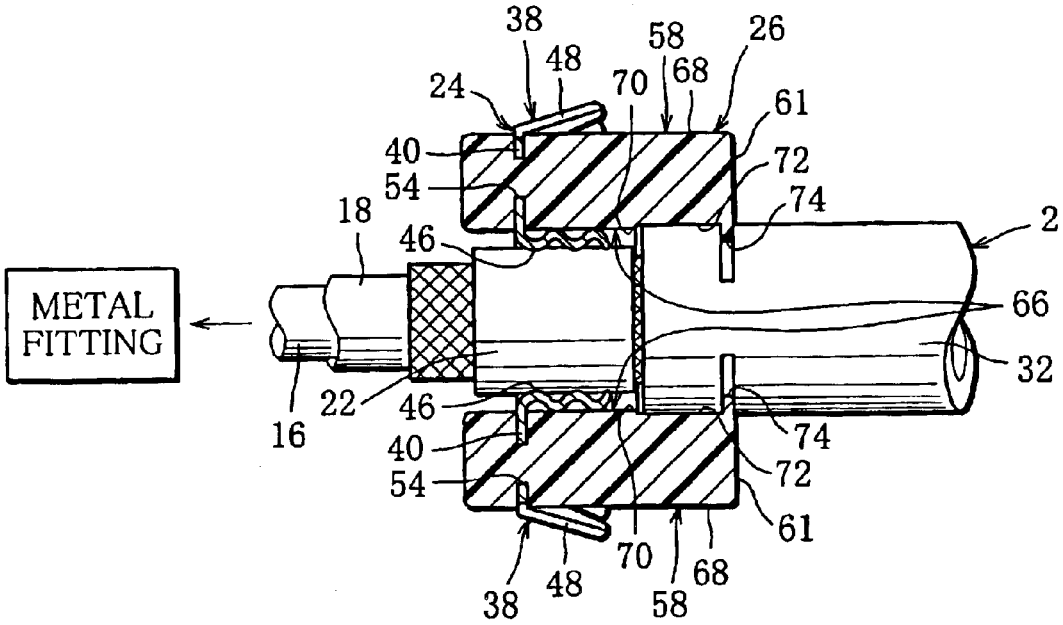
FIG. 7 is a sectional view showing another shield-connecting member and carrier member utilized for the connector shown in FIG. 1.

In the above-mentioned embodiment, the shield-connecting 15 member 24 and the carrier member 26 are fixed to each other by the claw 56 engaged with the projection 64. As illustrated in FIG. 7, however, it is preferable that the half body 38 of the shield-connecting member 24 and the resinous member 58 of the carrier member 26 be integrally molded by insert molding. This is because the integral molding can eliminate a process of connecting the half body 38 to the resinous member 58 and can reduce the number of components.

Although in the embodiment the carrier member 26 surrounds the exposed shield layer 20 and the sheath 32, the carrier member 26 may surround only the exposed shield layer 20.

In the embodiment, the corrugated connecting portion 46 may be formed flat instead of corrugated. It is preferable, however, that a surface of the connecting portion 46, that is brought into contact with the metal tape 22, have concavities and convexities like the corrugated connecting portion 46 since such structure can strengthen contact pressure between the metal tape 22 and the connecting portion 46. Furthermore, it is also preferable that a tip end portion of the connecting portion 46 opposite to the inner circumference 42 be bent to the metal tape 22 side. Although it is preferable that the exposed shield layer 20 be wound with the metal tape 22, the shield layer 20 and the corrugated connecting portion 46 may be brought into direct contact with each other without winding the metal tape 22 around the shield layer 20.

What is claimed is:

1. A shield electric cable connector for electrically connecting a shield electric cable to a mate member, the shield electric cable including one terminal portion peeled for said connector and the mate member, the terminal portion having a conductive shield layer exposed from a sheath of the shield electric cable, the connector comprising:

a conductive shield pipe surrounding the terminal portion of the shield electric cable; and a conductive shield-connecting member surrounding the exposed shield layer between the exposed shield layer and the shield pipe, the shield-connecting member electrically connecting the exposed shield layer to the shield pipe, wherein:

the shield-connecting member has a pair of halves that sandwiches the exposed shield layer from both sides in a radial direction of the exposed shield layer, wherein each of the pair of halves includes:

a semi-circular shield wall portion having an inner and an outer circumference extending in a circumferential direction of the shield layer, a first contact portion integrally formed on the inner circumference of the shield wall portion, the first contact portion being brought into contact with the exposed shield layer, and a plurality of second contact portions integrally formed on the outer circumference of the shield wall portion and arranged along the outer circumference of the shield wall portion, the second contact portions being brought into contact with the shield pipe.

2. The connector according to claim 1, wherein the second contact portions of the halves are brought into contact with the shield pipe while being elastically deformed.

3. The connector according to claim 2, further comprising:

a resinous carrier member for supporting the halves, the carrier member having an inner circumferential surface, extended in an axial direction of the shield electric cable, for surrounding the exposed shield layer, and an end face to which the shield wall portions of the respective halves are fixed.

4. The connector according to claim 3, wherein the support member includes a pair of resinous bodies, and the resinous bodies have respective engagement portions for being engaged with each other.

5. The connector according to claim 4, wherein the inner circumferential surface of the carrier member pushes the first contact portion of the half against the exposed shield layer.

6. The connector according to claim 5, wherein the inner circumferential surface of the carrier member surrounds the sheath located adjacently to the exposed shield layer and has a ridge portion integrally formed on the sheath side, the ridge portion elongating in a circumferential direction of the inner circumferential surface and biting into the sheath.

7. The connector according to claim 6, wherein the first contact portion of the half has corrugated surface brought into contact with the exposed shield layer.

8. The connector according to claim 7, wherein the resinous bodies of the carrier member are unitedly jointed to the respective halves by insert molding.

9. The connector according to claim 8, further comprising a metal tape that is interposed between the exposed shield layer and the first contact portions of the respective halves, the metal tape being wound around the exposed shield layer.

* * * * *